US010054905B2

(12) United States Patent
Paratte et al.

(10) Patent No.: US 10,054,905 B2
(45) Date of Patent: Aug. 21, 2018

(54) TIMEPIECE MECHANISM WITH ADJUSTABLE INERTIA BALANCE WHEEL

(71) Applicant: The Swatch Group Research and Development Ltd, Marin (CH)

(72) Inventors: Lionel Paratte, Neuchatel (CH); Donald William Corson, Yverdon-les-Bains (CH); Dominique Lechot, Les Reussilles (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/613,747

(22) Filed: Jun. 5, 2017

(65) Prior Publication Data

US 2017/0351218 A1 Dec. 7, 2017

(30) Foreign Application Priority Data

Jun. 3, 2016 (EP) ..... 16172843

(51) Int. Cl.
*G04B 18/00* (2006.01)
*G04B 17/06* (2006.01)
(Continued)

(52) U.S. Cl.
CPC ..... *G04B 18/006* (2013.01); *G04B 17/063* (2013.01); *G04B 17/20* (2013.01);
(Continued)

(58) Field of Classification Search
CPC ..... G04B 17/00; G04B 17/036; G04B 17/20; G04B 18/00; G04B 18/06
See application file for complete search history.

(56) References Cited

U.S. PATENT DOCUMENTS 2,880,570 A * 4/1959 Favret ..... G04B 18/006 368/170
9,128,465 B2 9/2015 Kawauchiya et al.
(Continued)

FOREIGN PATENT DOCUMENTS

CH 320818 4/1957
CH 333583 10/1958
(Continued)

OTHER PUBLICATIONS

European Search Report dated Nov. 16, 2016 in European application 16172843.1, filed on Jun. 3, 2016 (with English Translation of Categories of Cited Documents).

*Primary Examiner* — Vit W Miska
(74) *Attorney, Agent, or Firm* — Oblon, McClelland, Maier & Neustadt, L.L.P.

(57) ABSTRACT

Watch comprising a movement, with a balance comprising a ring distinct from the balance rim, elastically fixed to a flange with respect to which this ring is movable in rotation to modify the position of inertia blocks elastically carried by the flange, each able to be indexed in different stable angular positions corresponding to a different inertia of the balance, the movement including an operating member movable between coupled and uncoupled positions which includes a stop means for immobilizing the rim in a coupled position, and a control means for rotating the ring to modify the position of the inertia blocks in the coupled position, the watch including a crown controlling the control means, a rotating coupling ring controlling the coupling/uncoupling of the operating member through contactless interaction with an external adjustment tool.

17 Claims, 6 Drawing Sheets

(51) Int. Cl.

| | |
|---|---|
| ***G04B 17/20*** | (2006.01) |
| ***G04C 3/04*** | (2006.01) |
| ***G04D 7/08*** | (2006.01) |
| *G04B 17/00* | (2006.01) |
| *G04C 3/00* | (2006.01) |

(52) U.S. Cl.
CPC ..... *G04C 3/04* (2013.01); *G04D 7/084* (2013.01); *G04B 17/00* (2013.01); *G04B 18/00* (2013.01); *G04C 3/00* (2013.01)

(56) References Cited

U.S. PATENT DOCUMENTS

| | | | | |
|---|---|---|---|---|
| 9,547,278 | B2 * | 1/2017 | Graf | G04B 17/063 |
| 2012/0014229 | A1 * | 1/2012 | Mallet | G04B 17/063<br>368/175 |
| 2013/0188461 | A1 * | 7/2013 | Mallet | G04B 17/063<br>368/173 |
| 2014/0185418 | A1 * | 7/2014 | Nakajima | G04B 15/06<br>368/127 |
| 2014/0241134 | A1 * | 8/2014 | Niwa | G04B 17/22<br>368/127 |

FOREIGN PATENT DOCUMENTS

| | | |
|---|---|---|
| CH | 342898 | 11/1959 |
| CH | 709 052 A2 | 6/2015 |
| DE | 928 398 | 5/1955 |

* cited by examiner

Fig. 9
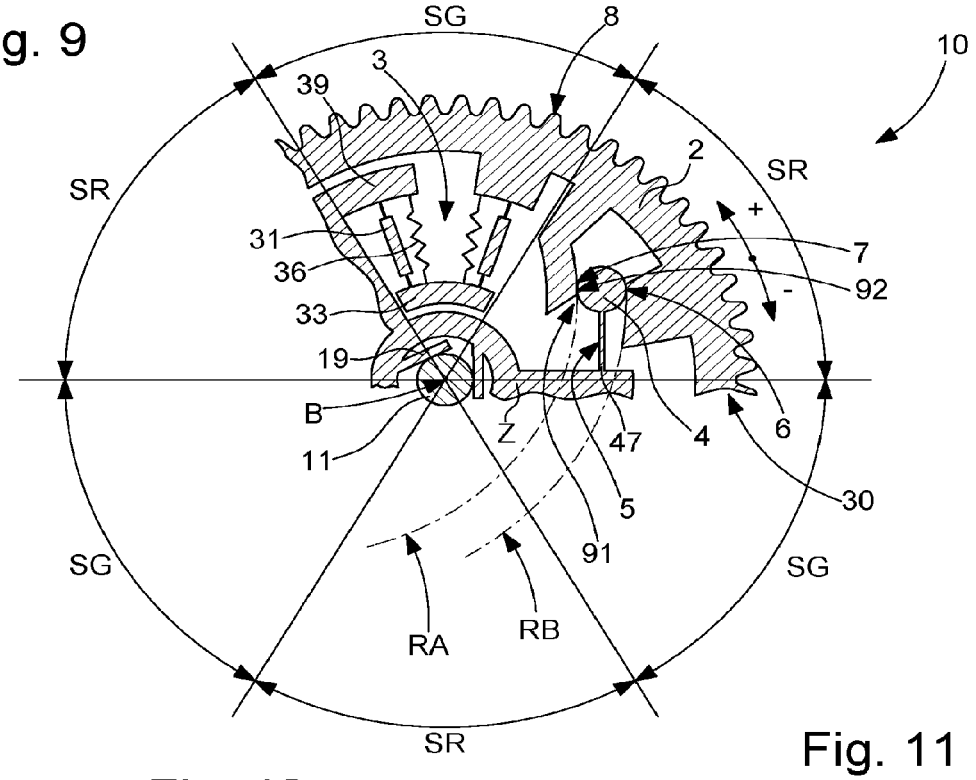
Fig. 11
Fig. 10
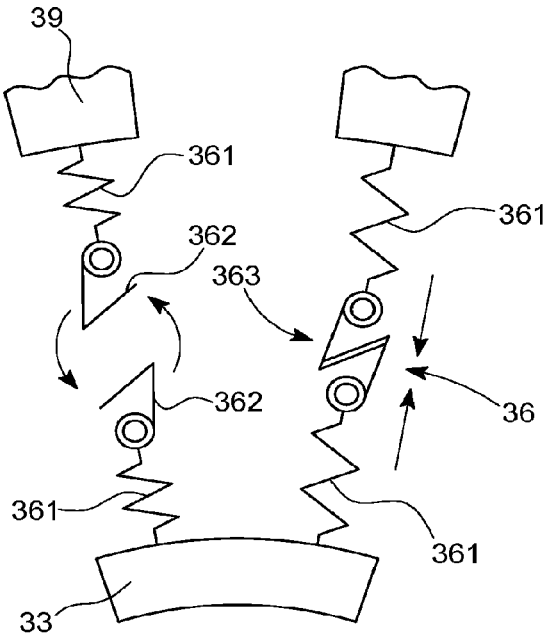
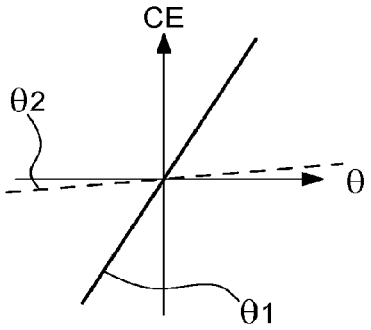
Fig. 13
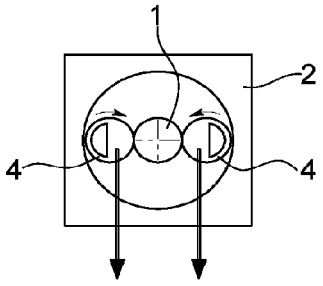

Fig. 17
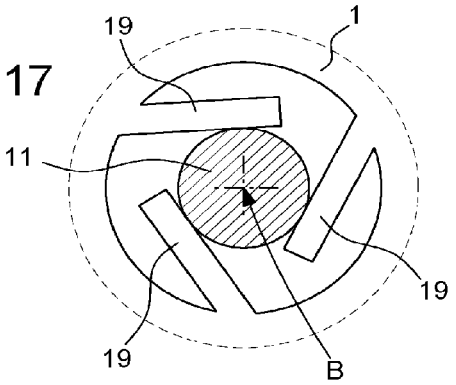
Fig. 19
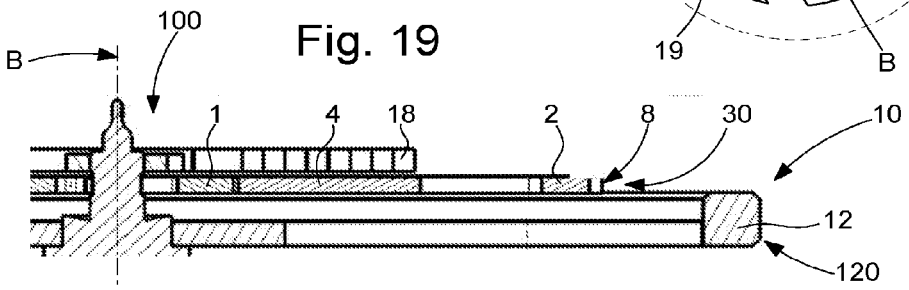
Fig. 20
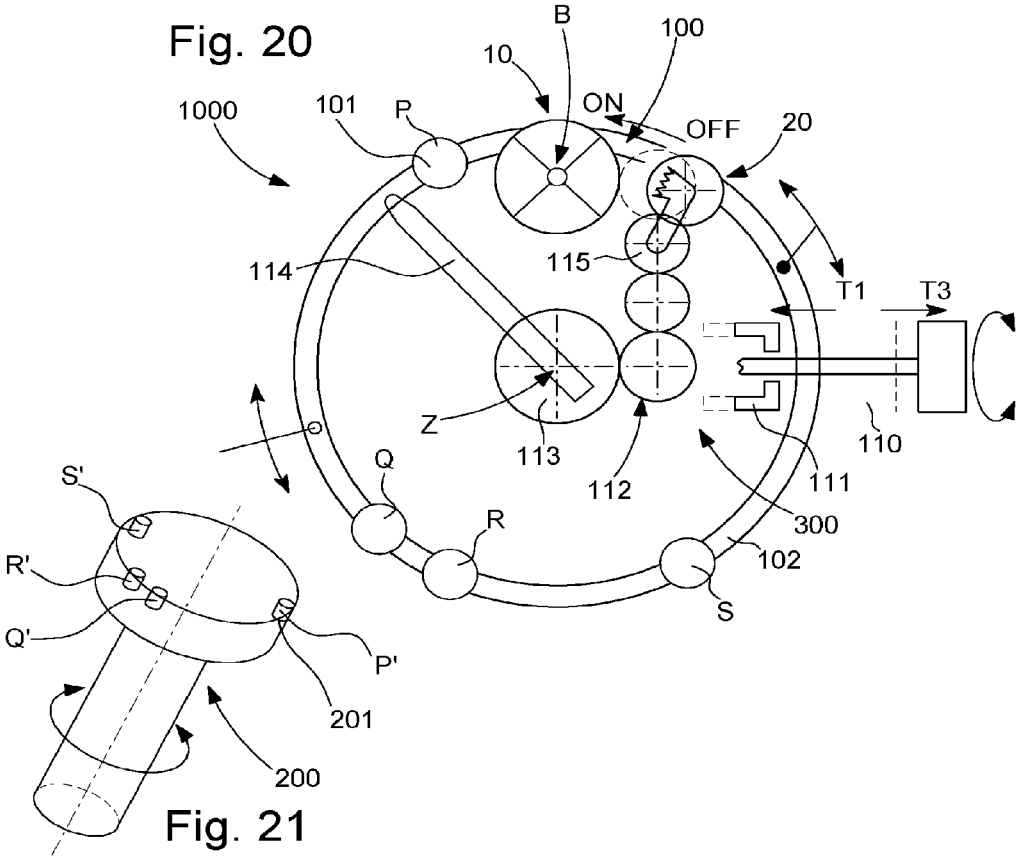
Fig. 21

TIMEPIECE MECHANISM WITH ADJUSTABLE INERTIA BALANCE WHEEL

This application claims priority from EP No. 16172843.1 filed on Jun. 3, 2016, the entire disclosure of which is hereby incorporated herein by reference.

FIELD OF THE INVENTION

The invention concerns a timepiece balance wheel with adjustable inertia, comprising a staff carrying, on the one hand, a rim via at least one arm, and on the other hand an inner flange secured to said staff and carrying an outer ring via a plurality of first elastic guide connections, which are inertia balanced in a plane perpendicular to the axis of said staff and in a perpendicular plane to said axis, said outer ring being separate from said rim, and said balance comprising a plurality of inertia-blocks.

The invention also concerns a mechanical timepiece movement including at least one timepiece oscillator mechanism including one such balance.

The invention also concerns a watch comprising such a movement, and a control member consisting of a push-piece or a crown arranged to control the movement of a motion-work via a sliding pinion.

The invention also concerns a timepiece assembly including such a watch, and an adjustment tool arranged to allow adjustment of the inertia of said balance.

The invention concerns the field of mechanical timepiece movements with a balance wheel oscillator, and adjustment of the rate of such an oscillator.

BACKGROUND OF THE INVENTION

To set the rate of a mechanical watch, it is generally necessary to open the case and remove the movement, to then access the components for setting the rate: rotating the index to change the rigidity of the balance spring, rotating the balance screws to change the inertia, or other means. This operation therefore requires additional time-consuming operations. Moreover, it is also necessary to recheck the sealing. Sometimes, also, the rate may thrown out during the operation of casing up the movement.

In existing mechanisms, the movement must be disassembled to access the setting members, since the structure does not permit internal setting. Further, the risk of introducing unbalances during timing is not minimised.

CH Patent Application No 709052A2 in the name of Seiko instruments discloses a balance wheel composed of two parts, one of which is rigid and provided with two cams at 180°, and the other is composed of two resilient arms resting on the cams, which end in inertia blocks. A first rim forms the actual balance, and comprises a guide part configured to vary the distance, with respect to the balance staff, of a resilient part arranged to slide along the guide part, and which is capable of elastic deformation in the radial direction around the balance staff. A second rim comprises a plurality of inertia block portions. The relative rotation between these two parts causes a change in inertia through the radial travel of the inertia blocks. A variant is provided with a toothing allowing the insertion of a special tool ending in two pins; rotating this tool causes a precise tangential displacement of the inertia blocks. Although advantage is taken of the absence of play, this timing system requires disassembly of the movement in order for the tool to access the balance. This timing mode does not prevent the appearance of inadvertent unbalances during timing: the angular movement imparted by the tool at one of the ends risks producing a lower amplitude shift at the other diametrically opposite end, due to friction.

CH Patent Application No 708675A1 in the name of Sercalo Microtechnology Ltd describes a one-piece "LIGA" metal (Lithografie, Galvanoformung and Abformung) or "DRIE" (Deep Reactive Ion Etching) structure, comprising several elastic strips between an inner securing lozenge shaped part and a slightly elliptical outer ring, able to be secured by elastic forces inside a rim. Motion is started by rotating the outer resilient ring with the aid of tweezers, which moves the strips closer to or further from the centre, and changes the inertia. However, there is no integrated timing tool. Even using silicon technology, which can achieve very high manufacturing precision for this part, with the positioning of the elliptical ring being effected at two points, there is a risk of an unbalances appearing.

CH Patent Application No 320818A in the name of H. Siegwart also describes elastic strips and an elastic support resting inside the rim.

SUMMARY OF THE INVENTION

The invention proposes to develop a solution for setting the rate of a mechanical movement, without having to open the watch case, and without introducing any unbalance.

The proposed solution preferably uses the high precision of silicon microfabrication, or similar, to reduce to a maximum any unbalances introduced during timing, and especially to propose a solution allowing timing to be performed without having to disassemble the watch, with timing means integrated inside the movement.

To this end, the invention concerns a timepiece balance wheel with adjustable inertia, comprising a staff carrying, on the one hand, a rim via at least one arm, and on the other hand an inner flange secured to said staff and carrying an outer ring via a plurality of first elastic guide connections, which are inertia balanced in a plane perpendicular to the axis of said staff and in a perpendicular plane to said axis, said outer ring being separate from said rim, and said balance comprising a plurality of inertia-blocks, characterized in that said outer ring is arranged to pivot with respect to said inner flange under the action of an external torque exerted against a resistant torque exerted by said first elastic guide connections, and characterized in that each said inertia block he is carried at least by said inner flange via at least a second elastic connection and can be indexed in a stable angular position defined by the respective cooperation between a first indexing toothing carried by said inner flange or by said inertia block, and a second indexing toothing which is respectively carried by said inertia block or by said outer ring, and in that any rotation of said outer ring with respect to said inner flange changes the angular position of said inertia blocks.

More particularly, this balance wheel comprises a staff carrying, on the one hand, a rim via at least one arm, and on the other hand, a one-piece upper plate comprising an inner flange, fixed to said staff, and an outer ring, which are connected by a plurality of first elastic guide connections balanced in a perpendicular plane to the axis of said staff.

The invention also concerns a mechanical timepiece movement including at least one timepiece oscillator mechanism including one such balance.

The invention also concerns a watch comprising such a movement, and a pre-existing control member consisting of a push-piece or a crown arranged to control the movement of a motion-work via a sliding pinion.

The invention also concerns a timepiece assembly including such a watch, and an adjustment tool arranged to allow adjustment of the inertia of said balance.

BRIEF DESCRIPTION OF THE DRAWINGS

Other features and advantages of the invention will appear upon reading the following detailed description, with reference to the annexed drawings, illustrating two families of variants, in which:

FIG. 9 shows a partial schematic top view of a mechanism wherein the inertia adjustment and guiding are alternated by 60° sectors substantially according to the variants respectively of FIGS. 5 and 6.

FIG. 10 shows a partial, schematic, top view of a detail with radially mounted springs, for reducing the elastic return torque, and FIG. 11 illustrates the variation in elastic torque as a function of the angle of deformation, in a solid line without the springs and in a dotted line with the springs.

FIG. 13 is a diagram showing that torques caused by unbalances in the planetary inertia blocks of FIG. 12 in the event of linear shock cancel each other out and do not cause any involuntary rotation of the outer ring.

FIG. 17 is a detail of a variant embodiment of the upper or lower plate of the balance with a plurality of elastic strips clamping the balance staff.

FIG. 19 shows a schematic, cross-sectional view of a sprung balance comprising a one-piece upper plate according to the invention and wherein the locking of the rim occurs in this case by friction on the external diameter of the rim.

FIG. 20 shows a schematic, top view of a watch comprising a timepiece movement, with a sprung balance including a balance according to the invention, with its inertia adjustment control mechanism controlled by the crown, and, in perspective, an external tool, associated with this type of watch, arranged to control in a contactless manner, through the watch case, the coupling ring of FIG. 16.

FIG. 21 shows an adjustment tool including a magnetic key according to embodiments of the invention.

DETAILED DESCRIPTION OF PREFERRED EMBODIMENTS

The invention proposes a solution for setting the rate of a mechanical movement, without opening the watch case, with an inertia adjustment device concerning both a specially equipped oscillator, and control means accessible to a user from the outside of the watch case, for example via the winding and time setting stem, via a push piece, or other means.

As seen in particular in FIG. 20, the invention is described for a watch 1000, comprising a mechanical movement 300, in turn comprising at least one oscillator 100 comprising at least one balance 10, notably a sprung balance oscillator, comprising a balance 10 and at least one balance spring 18.

More particularly, the inertia adjustment device according to the invention comprises a flexible structure for adjusting the rate of the balance.

Figure 1:
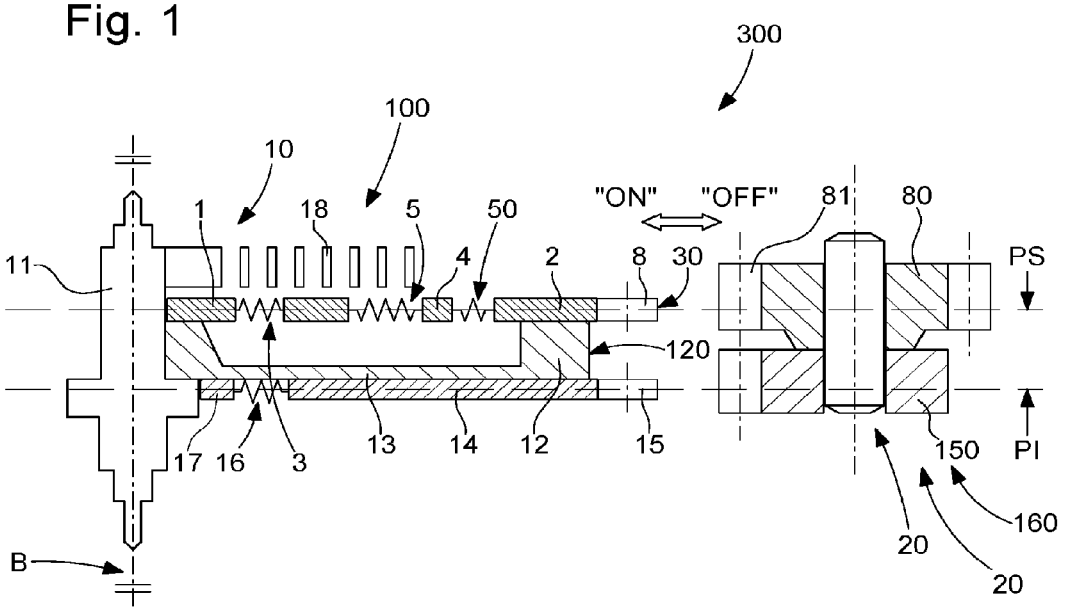
FIG. 1 shows a schematic, cross-sectional view of a timepiece balance wheel with adjustable inertia according to the invention, which includes, in a first upper plane, an outer ring carrying a peripheral toothing, elastically mounted with respect to an inner flange integral with the balance staff, and arranged to control the movement of inertia blocks of the balance, and, in a second lower plane parallel to the first plane, a support and holding surface, consisting of an outer surface of the balance rim, or of a toothing of a lower plate. This balance is represented facing an operating member according to the invention, which includes, on the upper plane, a control toothing arranged to cooperate with the peripheral toothing, and on the lower plane, a complementary support and holding surface.
Figure 2:
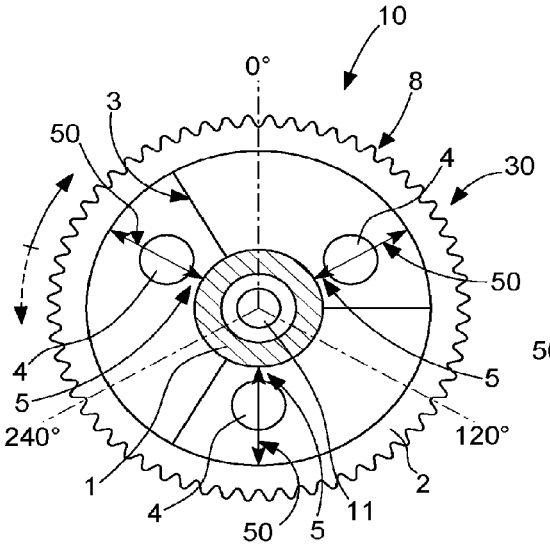
FIG. 2 is a schematic diagram of an upper plate comprising, between the inner flange and the outer ring, on the one hand, three first elastic connections at 120° from each other, performing a rotational guiding function, and, inserted between said connections, and also disposed at 120° from each other, three inertia blocks each suspended on either side by a second elastic connection (not shown).
Figure 3:
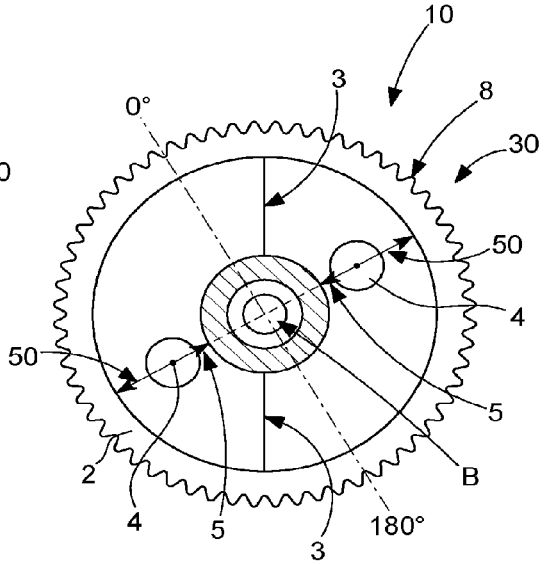
FIG. 3 is similar to FIG. 2, but with the two first elastic connections at an angle of 180° instead of 120°, and only two inertia blocks.

As seen in the Figures, particularly in FIGS. 1 to 3, the invention concerns a timepiece balance 10 with adjustable inertia, comprising a staff 11 which carries at least one rim 12 via at least one arm 13. This balance 10 includes at least one inner flange 1 attached to staff 11, and at least one outer ring 2, which is distinct from rim 12.

Figure 18:
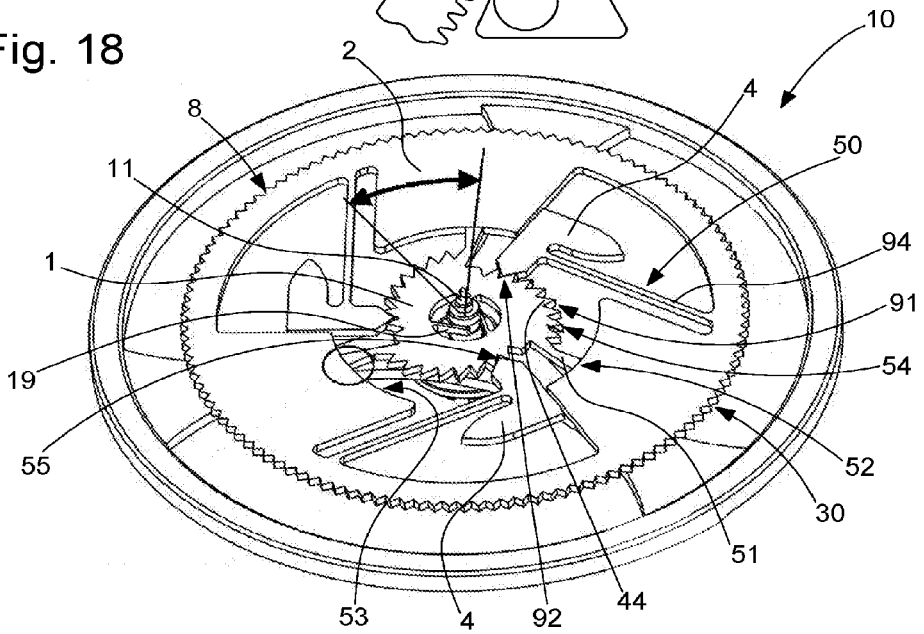
FIG. 18 shows a schematic, perspective view of a particular embodiment of the second family of variants, in a balance wheel variant which is an inertia adjustment structure with a central spiral, in which pivoting is achieved by friction on three centring supports.

According to variants of the invention, this outer ring 2 can be fixed in various ways:

in the preferred first family variants of FIGS. 4 to 9 and 12 to 16, outer ring 2 is directly connected to an inner flange 1, with which it preferably forms a one-piece assembly, by a plurality of first elastic guide connections 3;

in the second family variant of FIG. 18, inner flange 1 directly or indirectly carries outer ring 2 with, between inner flange 1 and outer ring 2, a plurality of first elastic guide connections 3. In the illustrated variant, inner flange 1 and outer arm 2 are arranged to pivot with respect to each other, are coplanar and distinct. Depending upon the amplitude of rotational freedom, a one-piece embodiment is possible, and in that case, requires an additional level.

In either case, the first elastic guide connections 3 are balanced in a plane perpendicular to axis B of staff 11, so that staff 11 is positioned exactly at the centre of inertia of the structure to avoid unbalances, in particular in the case where inner flange 1 and outer ring 2 form part of the same one-piece structure. This outer ring 2 is arranged to pivot with respect to inner flange 1, under the action of an external torque exerted against a resistant torque exerted by first elastic guide connections 3.

Balance 10 includes a plurality of inertia blocks 4.

Figure 4:
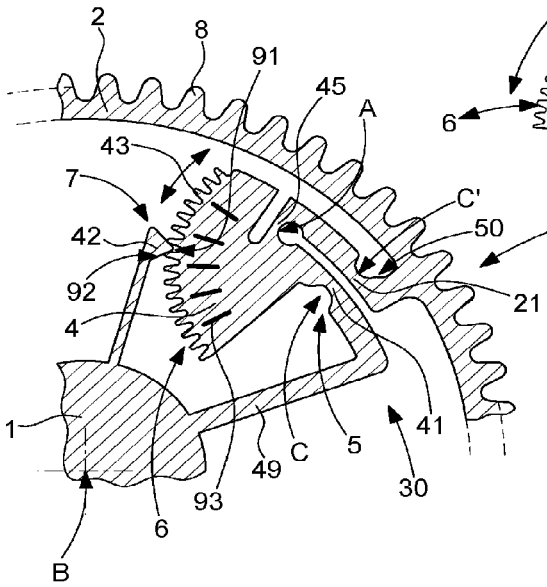
FIG. 4 shows a partial, schematic, top view of one part of the inertia adjustment mechanism, in a first variant wherein the inertia block includes a toothed sector which is suspended by a connection with three neck portions which together define a symmetrical isosceles triangle with respect to a perpendicular to a radial line from the balance staff, between two radial arm sections, one originating from the inner flange of the balance, and the other originating from the outer ring; the inner flange also carries a radially projecting jumper spring cooperating to stop and hold the teeth of the toothed sector, which comprises a graduation marking the angular position of the inertia block.
Figure 5:
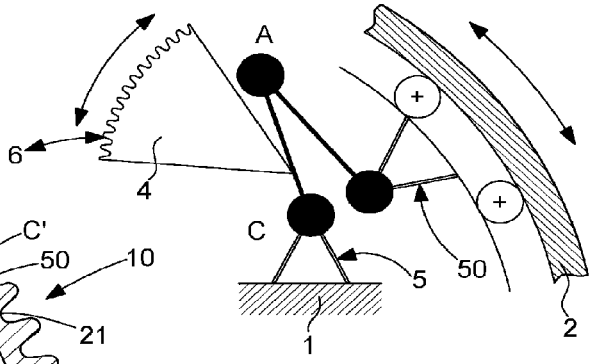
FIG. 5 is a simplified illustration of the connections of the mechanism of FIG. 4.
Figure 12:
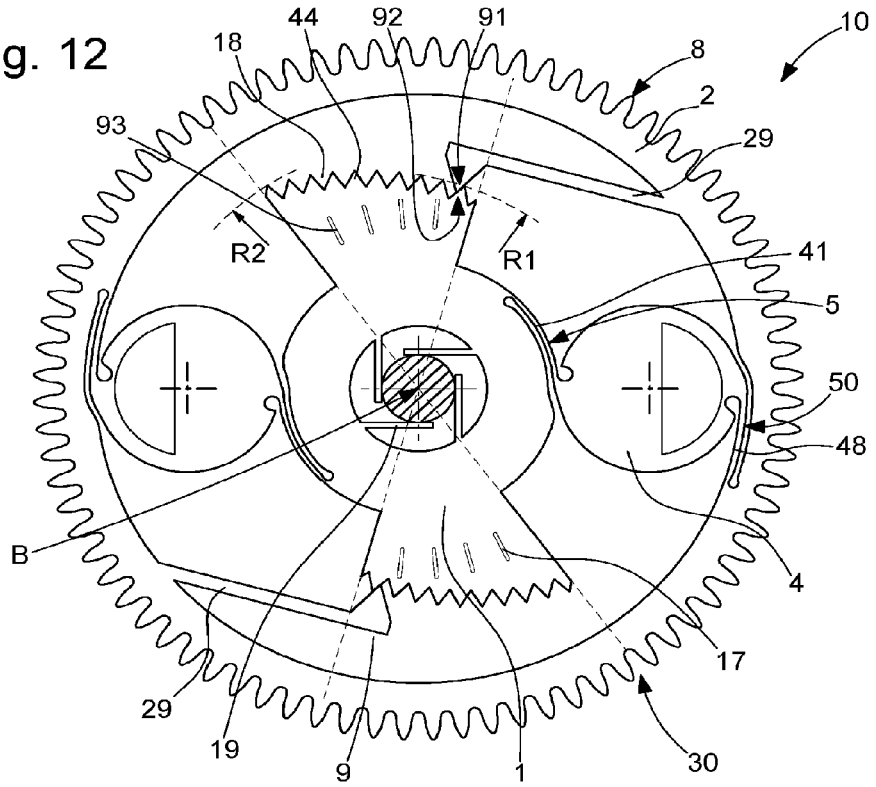
FIG. 12 shows a schematic, top view of a third variant with a flexible planetary structure, wherein the inner flange directly carries toothed sectors which, if needed, may be non-concentric to the balance staff, indexed in position by a jumper spring integral with the outer ring, and wherein planetary inertia blocks are each connected both to the inner flange and to the outer ring, by substantially concentric elastic strips.
Figure 14:
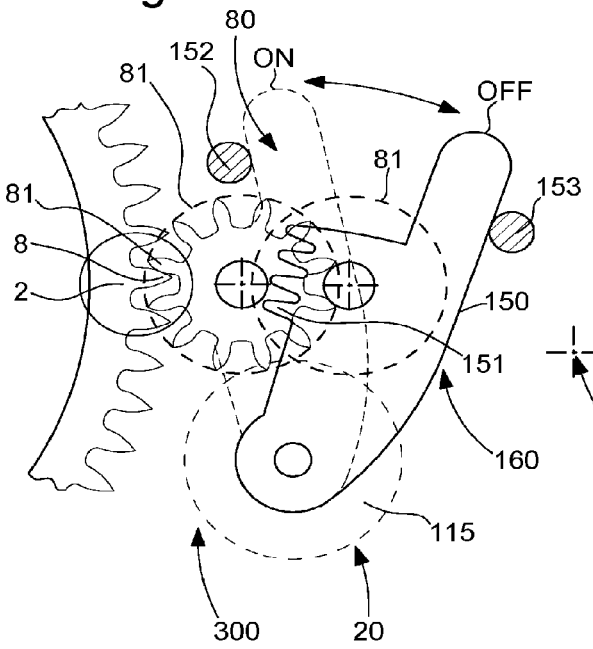
FIG. 14 shows a partial, schematic, top view of a detail of a timepiece movement comprising such a balance wheel, at the interface, in the upper plane, between the outer ring and the operating member controlling the rotation thereof, comprising a lever provided with wheels, the body of the lever being visible in a lower plane distinct from the upper plane, in which meshing occurs between a drive wheel comprised in the operating member and an outer toothing comprised in the outer ring.

In the variants:

in the first family of variants of FIGS. 4 to 9 and 12 to 16, these inertia blocks are each fixed by at least a second elastic connection 5 to an inner flange 1 and, depending on the variants, may also be fixed by a third elastic connection 50 to an outer ring 2, as seen notably in FIGS. 1, 4 and 12. Each inertia block 4 includes position indexing means 6, which are arranged to cooperate in a stable position with complementary position indexing means 7 comprised in an inner flange 1 and/or an outer ring 2;

in the second family of variants of FIG. 18, each inertia block 4 is carried by outer ring 2 by means of at least one outer flexible strip 94, and can be indexed in a stable angular position defined by the cooperation between a first indexing toothing 91 carried by inner flange 1 and a second indexing toothing 92 which is carried by inertia block 4.

The invention is more particularly described in the simple case where the balance includes a single inner flange 1, a single outer ring 2, and is easy to extrapolate for a design with several levels.

According to the invention, any rotation of outer ring 2 with respect to inner flange 1 modifies the angular position of these inertia blocks 4.

More particularly, but in a non-limiting manner, the position indexing means 6 and complementary position indexing means 7 comprise teeth. It is also possible to imagine achieving a magnetic or other type of indexing.

Figure 6:
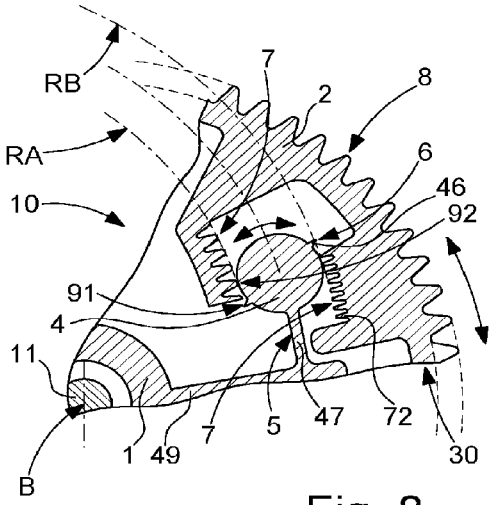
FIG. 6 shows a partial, schematic, top view of one part of the inertia adjustment mechanism, in a second variant, called the cam variant, wherein the inertia block is a disc comprising two opposite teeth, attached by a flexible strip perpendicular to a radial arm originating from the inner flange of the balance, and wherein the outer ring carries, on paths that are not concentric to the balance staff, two toothed sectors which cooperate with the two teeth of the inertia block.

In this variant with teeth, and as seen in particular in FIGS. 4 and 6, balance 10 comprises a plurality of inertia blocks 4. In the first family of variants, each of inertia blocks 4 is carried at least by inner flange 1 by at least a second elastic connection 5 and each can be indexed in a stable angular position defined by the cooperation between a first indexing toothing 91 carried by inner flange 1 or by inertia block 4, and a second indexing toothing 92. This second indexing toothing 92 is carried by inertia block 4 or by outer ring 2 when first indexing toothing 91 is carried by flange 1, or is carried by outer ring 2 when first indexing toothing 91 is carried by inertia block 4. In the second family of variants, each inertia block 4 is carried by outer ring 2.

Every rotation of outer ring 2 with respect to inner flange 1 under the action of an external torque modifies the angular position of inertia blocks 4 of balance 10, each carried by inner flange 1 by elastic connection 5 and able to be indexed in different stable angular positions corresponding to different inertias of balance 10. The rotation of outer ring 2, modifying the position of inertia blocks 4, thus modifies the inertia setting of balance 10.

FIG. 1 represents a timepiece balance 10 according to the invention, which includes, in a first upper plane PS, an outer ring 2 carrying a peripheral toothing 8 and elastically mounted with respect to an inner flange 1 integral with staff 11 of balance 10. Balance 10 comprises, in a second lower plane PI parallel to first upper plane PS, an angular support and holding surface of the balance, which consists, either of an outer surface 120 of rim 12 of balance 10, or of a toothing 15 of a lower plate 14, or similar; lower plate 14 is represented with a lower elastic connection 16 with a hub 17 fixed to staff 11. This balance 10 is represented facing an operating member 20 according to the invention, which includes, on upper plane PS, a control means 80, notably carrying a control toothing, in the form of a drive wheel 81, arranged to cooperate with peripheral toothing 8 of outer ring 2, and on lower plane PI, a complementary support and holding means 150, arranged to cooperate with outer surface 120 of rim 12 notably by elastic friction support, or toothing 15 of lower plate 14 by locking engagement. Although the cooperation through toothings on upper plane PS and lower plane PI is convenient, it is non-limiting, and may also consist of a friction or other means.

More particularly, the inertia variation function is achieved in an integrated and redesigned balance rather than being added in this manner. A lower plate 14 is fixed to balance staff 11, while a one-piece upper plate 30 is fixed at its centre to balance staff 11, but can rotate on its exterior. Centring springs with respect to balance staff 11, advantageously made in the form of elastic strips 19, seen in FIG. 17, can cancel out any voluntary unbalance introduced by either of the added lower or upper plates 14 and 30. Care will be taken to carefully adapt the number of elastic strips to the type of material. For example, since the stiffness of single crystalline silicon is anisotropic, and for example in the case of a section perpendicular to the (100) crystalline plane has an azimuthal period of 90°, this number should be even and equal to or greater than 4. In the case of an isotropic material, this number may be odd and equal to or greater than 3. After insertion on staff 11, the centres of these plates are preferably permanently fixed thereto by a means such as, but not limited to, adhesive bonding or brazing.

In an alternative, the elastic strips clamping balance staff 11 must exert a friction greater than the maximum torque exerted on outer ring 2 during inertia adjustment. To this end, operating member 20 implemented to perform the inertia adjustment advantageously includes a calibration device for limiting the torque imparted to outer ring 2.

In an advantageous embodiment, balance 10 includes a one-piece upper plate 30 which includes inner flange 1, first elastic guide connections 3, outer ring 2, inertia blocks 4, second elastic connections 5, first indexing toothings 91, and second indexing toothings 92, and third elastic connections 50, when balance 10 contains the same.

In a particular embodiment, inner flange 1 comprises a plurality of elastic strips 19 concentrically clamping staff 11 with a friction torque greater than the maximum value of the external torque.

In another particular embodiment, inner flange 1 is irreversibly fixed to staff 11, by soldering, brazing, adhesive bonding or another similar method.

In yet another embodiment, inner flange 1 includes a plurality of elastic strips 19 concentrically clamping staff 11 with a friction torque greater than the maximum external torque value, and these elastic strips 19 are irreversibly fixed to staff 11, by soldering, brazing, adhesive bonding or another similar method. In an advantageous variant, to achieve better stopping in an angular position than simply resting on the rim, balance 10 comprises a lower plate 14 directly or indirectly fixed to staff 11 and comprising a peripheral stop means 15, such as a toothing similar.

In an advantageous variant, for precise control of the inertia adjustment, outer ring 2 comprises a peripheral and continuous toothing 8 centred on axis B of staff 11, and the rotation of toothing 8 modifies the position of inertia blocks 4 between two stable indexing positions.

In a particular embodiment, inner flange 1 is integral with staff 11.

In a particular embodiment, balance 10 contains a flexible single-layer, micromachined structure, benefiting from the high contour precision of MEMS technologies, typically 1 to 2 micrometers of positioning precision, for a thickness of 150 micrometers, forming a one-piece upper plate 30, as defined above.

Preferably, in order to provide the system with maximum precision, the plates are micromachined (techniques derived from fabrication on silicon) and, if possible, each in a single layer (method using a mask), as represented.

In this way it is possible to add such a one-piece upper plate 32 to an existing balance to provide it with the inertia adjustment function offered by the invention, without occupying any significant volume inside the oscillator.

When balance 10 includes a lower plate 14, the latter can also be made in MEMS or similar technology.

Of course, any other equally precise, suitable technology known to those skilled in the art can be envisaged, such as laser or water jet cutting, or other.

FIGS. 2 to 11 illustrate variants of flexible inertia adjustment mechanisms according to the invention, in the preferred but non-limiting embodiment comprising a one-piece upper plate 30.

Generally, as seen in FIGS. 2 and 3, outer ring 2, notably provided with a toothing 8 in the preferred embodiment illustrated, can pivot elastically with respect to its centre, which is fixed to a balance staff 11 as explained above. Angular portions of 180°, 120°, 90°, 72°, . . . , respectively 2, 3, 4, 5, . . . , in number are disposed between the centre and outer ring 2. They are responsible for performing the two main functions, namely of guiding, for example with elastic strips, and of inertia adjustment, for example with movable inertia blocks. It is possible to imagine these functions being alternated by angular sector, or integrated if this is possible. The rule of adapting the number of sectors to the material, cited above for the number of centring strips, also applies here.

FIGS. 2 and 3 illustrate two variants, at 120° and 180°, of an upper plate 30 comprising, between the inner flange and the outer ring, an alternation of first elastic connections performing the function of rotational guiding, and inserted therebetween, elastically suspended inertia blocks.

In a first variant seen in FIG. 4, the first indexing toothing 91 is carried by inner flange 1 and consists of a radially protruding inner jumper spring 42, and second indexing toothing 92 is carried by inertia block 4 and is a first toothed sector 43. This inertia block is suspended by a connection with three first neck portions 45, 21, 41, which together define an isosceles triangle ACC', symmetrical with respect to a perpendicular to a radial line originating from axis B of balance 10, between two radial arm sections, one originating from inner flange 1, and the other originating from outer ring 2. Inertia block 4, in the form of a sector circle, can pivot elastically at C, during the angular displacement of outer ring 2, moved by the triangle of elastic pivots C'-A-C. Inner jumper spring 42 cooperates in a retaining stop arrangement with the teeth of toothed sector 43 and allows precise positioning of inertia block 4. A graduated scale 93 on inertia block 4 allows its angular position to be read. Correct dimensioning of the mechanics causes the synchronised movement of all the inertia blocks into the same notches, at the risk of causing an unbalance. One variant consists of a mechanism comprising a single jumper spring and a single indexing rack for the entire structure, with a compensating inertia block for returning the centre of gravity to the centre of rotation of the balance.

In a second variant visible in FIG. 6, first indexing toothing 91 is carried by inertia block 4 and comprises at least one tooth 46, and second indexing toothing 92 is carried by outer ring 2 and comprises at least a second toothed sector 72 having a separate centre from axis B of staff 11. In this second variant, called the cam variant, inertia block 4 is a disc comprising two opposite teeth 46, attached by a flexible strip 47 perpendicular to a radial arm 49 originating from inner flange 1. Outer ring 2 carries, on paths, of radii RA and RB, not concentric to axis B of balance 10, which allows the inertia to be modified, two toothed sectors 72, which cooperate with the two teeth 46 of inertia block 4. The inertia modification arises from the change in radial position of inertia block 4, which in turn results from the change in relative angular position between the inertia block and outer ring 2, via the slope corresponding to radius RB or RA. This second variant comprises, like the first, a two-directional range of adjustment. It should be noted that, in the neutral position, in both solutions there is no clamping/stress between the jumper spring and rack, the space will be as small as is possible to micromachine slots in a single-layer method (only one photolithography mask). This space (of around 5 micrometers for a thickness of 0.10 mm) can of course be reduced to a distance of 0 or less (stressed state) for the other angular positions.

Figure 7:
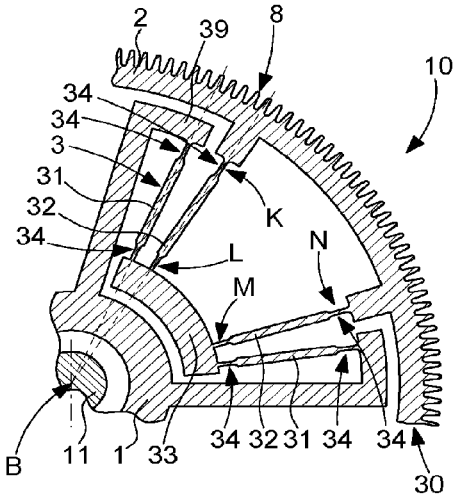
FIG. 7 shows a partial, schematic, top view of one part of a guide mechanism with flexible strips, in a variant wherein the inner flange carries radial arms which carry, via radial elastic strips each having two neck portions, an intermediate concentric sector which is suspended by two other radial elastic strips each having two neck portions, to the outer ring.
Figure 8:
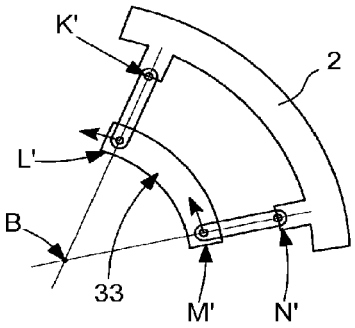
FIG. 8 is a simplified illustration of the connections of the mechanism of FIG. 7.

FIG. 7 illustrates a guide mechanism with flexible strips, in a variant wherein inner flange 1 carries radial arms which in turn carry, via radial elastic strips 31 each having two neck portions 34, an intermediate concentric sector 33, which is suspended by two other radial elastic strips 32 each having two neck portions 34, to outer ring 2. Outer ring 2 is suspended on two strips joined at the centre, fixed on intermediate bend 33, which is in turn connected to inner flange 1. This involves placing two RCC (remote centre compliance) rotating guides in series. The principle is explained in FIG. 8, which illustrates the articulated connection at the second neck portions, for a semi-structure with the four second neck portions 34 replaced by pivots K'L'M'N'. It is clearly seen that the instantaneous centre of rotation for low amplitudes is on axis B of staff 11 of balance 10.

FIG. 9 illustrates a mechanism wherein the inertia adjustment and guiding are alternated in 60° sectors substantially according to the variants respectively of FIGS. 6 and 7. The inertia modification arises from the change in radial position of inertia block 4, which in turn results from the change in relative angular position between the inertia block and outer ring 2, via the slope corresponding to radius RB or RA. Between the radial arms originating from inner flange 1 and outer ring 2, there can be seen pairs formed of the radial elastic arms 31 seen above, and also radially mounted springs, for reducing the elastic return torque. These springs decrease the natural rotational stiffness of the strips, if it is wished to avoid an excessive torque exerted on outer ring 2 and to use an indexing rack/jumper spring system with a constant low force. Since it is impossible to lithograph taut springs, it is possible to use hooks to put under tension springs fabricated in a relaxed position: advantageously, when balance 10 includes a one-piece plate 30, produced by a LIGA or MEMS or similar method, Each spring 36 consists of half springs 361, provided with hooks 362 arranged head-to-tail, distant from each other during the production of one-piece plate 30, as seen on the left part of the Figure, and which then only need to be hooked up to form a coupled unit 363 to obtain the required return force. FIG. 11 illustrates the variation in elastic torque CE as a function of the angle of deformation A, in a solid line without these springs and in a dotted line with the springs.

In a third variant illustrated in FIG. 12, first indexing toothing 91 is carried by inner flange 1, and includes a third toothed sector 44 whose centre is distinct from axis B of staff 11, and second indexing toothing 92 is carried by outer ring 2, and consists of an external jumper spring 29. More particularly, balance 10 includes here a one-piece upper plate 30, which is a flexible planetary structure, whose planets are unbalance inertia blocks permitting inertia adjustment, which are connected to inner flange 1 and/or to outer ring 2 by means of elastic strips.

Inner flange 1 directly carries toothed sectors 44, which are not concentric with axis B of balance 10, each indexed in position by an external jumper spring 29 integral with outer ring 2, and wherein inertia blocks 4 are each connected both to inner flange 1 and to outer ring 2, by elastic strips 48 which are substantially concentric to each other and to axis B of staff 11.

This third variant functions like a planetary movement, in which the two inertia blocks 4 (planets) roll between inner flange 1 and outer ring 2, which are held together by elastic arms 48 which are wound around inertia blocks 4. As the angle of rotation increases, the elastic return torque due to elastic strips 48 can vary, notably but not necessarily, increasing. Therefore, to prevent the indexing system running out of control, it is possible to incline the rack of third toothed sector 44 to obtain a retaining force that offsets the torque from strips 48 through the action of external jumper spring 29. In a particular embodiment, this retaining force is gradual. It is to be noted that this system is insensitive to shocks. Indeed, torques caused by unbalances in the inertia block/planets of FIG. 12 in the event of a linear shock cancel each other out and do not cause any involuntary rotation of outer ring 2, as seen in FIG. 13. This is also true for N inertia block/planets biased in any direction in the plane of the movement. External jumper springs 29 must overcome the return torques exerted by elastic strips 48 and, very importantly, centre outer ring 2 so as not to introduce any unbalance.

A particular embodiment of the second family of variants is illustrated in FIG. 18: this is an inertia adjustment structure with a central spiral, in which pivoting is not elastic, but achieved through friction on three centring supports. Inner flange 1 includes a notched spiral 44 fixed to staff 11 of balance 10, whereas outer ring 2 carries three inertia blocks 4 each secured by means of an outer flexible strip 94. Outer ring 2 includes three shoulders 53 on which three supports 52 slide, over an angular sector of 30°, corresponding to the range of adjustment, comprised in arms 51 of notched spiral 44. The relative rotation between outer ring 2 and notched spiral 44, which cooperates with teeth 55 of inertia blocks 4, causes the centrosymmetric deployment of inertia blocks 4. In a particular and non-limiting numerical application, for a balance 10 with a rim 12 of 10.6 mm diameter, a one-piece silicon upper plate 30 of 7.9 mm diameter and a thickness of 150 micrometers, a total inertia of 1.83. $10^{-9}$ kg·m$^2$, the inertia adjustment corresponding to the 30° of adjustment amplitude reaches 37.4 seconds per day. The notches of notched spiral 44 may, of course be adapted and reduced, particularly to achieve a required resolution, for example of 0.5 seconds per day. Advantageously, this mechanism also includes vertical guide elements (not represented in the Figure) to ensure retention of outer ring 2 at Z. The centring supports 52 of outer ring 2 and shoulders 53 are advantageously separated by a play of several micrometers. Thus, it is inertia blocks 4 that centre outer ring 2 perfectly on notched spiral 44, which is itself centred on staff 11 by flexible strips 19. When outer ring 2 is rotationally biased, the function of arms 51 is to ensure that teeth 55 of the three inertia blocks 4 drop synchronously into their notches in notched spiral 44, so that there is no discrepancy. Consequently, the torque exerted by the strips via these notches is higher than the friction torque at the end of the drop of the inertia blocks into the notches.

The invention also concerns a mechanical timepiece movement 300, as seen in particular in FIG. 20, comprising at least one timepiece oscillator mechanism 100 comprising such a balance 10, and an operating member 20 arranged to control the inertia adjustment of balance 10 by modifying the position of at least some of inertia blocks 4 comprised in balance 10. This operating member 20 is moveable between a coupled position and at least one uncoupled position. According to the invention, operating member 20 comprises a stop means 160 arranged to directly or indirectly immobilise rim 12 in the coupled position, and at least one control means 80, which is notably toothed, arranged, in the coupled position, to drive in rotation outer ring 2, notably a toothing 8 comprised in outer ring 2, to modify the position of the inertia blocks 4 which cooperate with outer ring 2.

The invention also concerns, as seen in particular in FIG. 20, a watch 1000 comprising such a movement 300, a control member consisting of a push-piece or a crown 110 arranged to control the movement of a motion-work 112 via a sliding pinion 111. This motion-work 112 comprises an input wheel 115, which is arranged to drive at least one such toothed control means 80 in the coupled position of operating member 20. Watch 1000 according to the invention comprises a coupling ring 102 that can be moved in rotation to control the coupling or uncoupling of operating member 20, and coupling ring 102 is preferably hidden from the user.

Such an arrangement makes it possible to transform an existing watch, comprising a pre-existing control member such as a crown, push piece, bezel, pull-out piece or suchlike, and a pre-existing sliding pinion and motion-work.

The invention is described here in the particular, non-limiting case, of a balance 10 comprising a one-piece upper plate 30, whose outer ring 2 includes a toothing 8.

Figure 16:
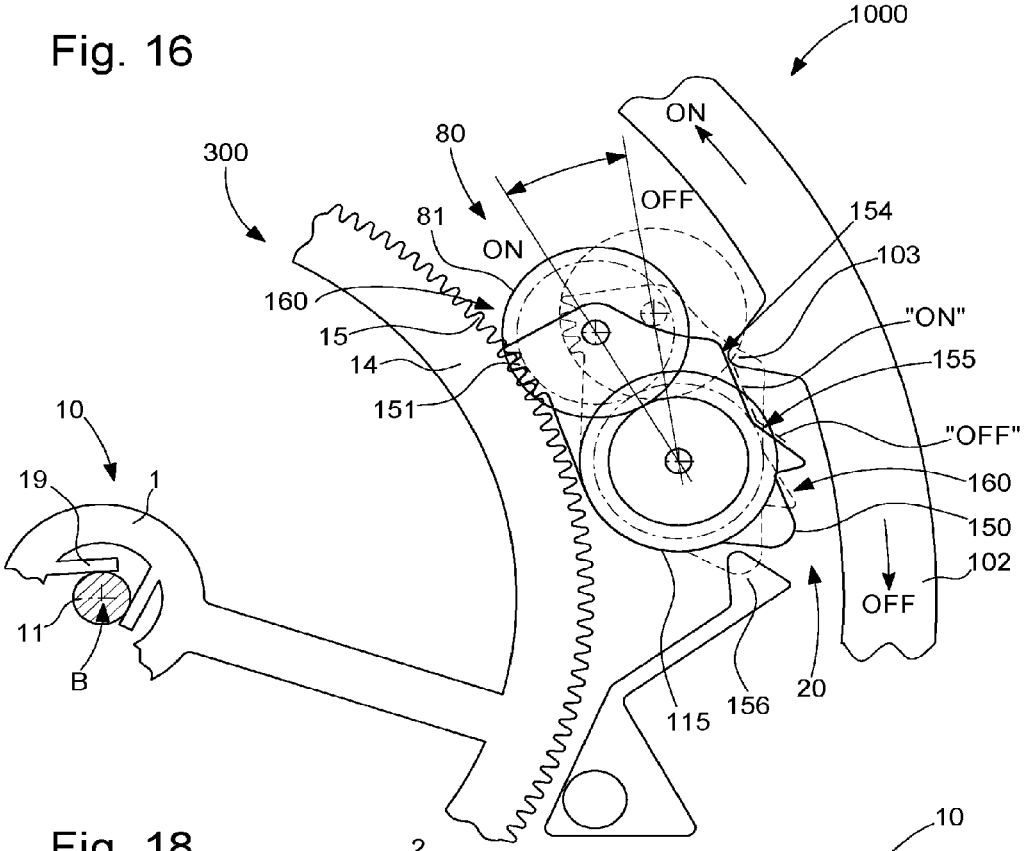
FIG. 16 shows a partial, schematic, top view of a detail of a watch including such a timepiece movement, in particular: a control mechanism comprising a coupling ring controlling the lever of FIG. 14, at the interface, in the lower plane, a toothing of a lower plate of the balance and a comb comprised in the lever, and, at the upper interface, the outer ring and the operating member, a wheel here, which controls the rotation thereof.

As seen in particular in FIG. 16, rotating this one-piece upper plate 30 relative to rim 12 of balance 10, or, as here relative to lower plate 14 when balance 10 includes one, and which is synchronous with rim 12, said rim 12 being previously locked in rotation, and in any angular position of rim 12, changes the inertia of one-piece upper plate 30, and thus of balance 10. The rotation of outer ring 2, notably of this one-piece upper plate 30, is accomplished by control means 80 of operating member 20, particularly in the form of a drive wheel 81 adjacent to balance 10, carried by a bistable lever 150 of stop means 160, in the non-limiting embodiment illustrated by the Figures. Lever 150 is coupled/uncoupled laterally by the mechanical action of a rotary ring 102 peripheral to the timepiece movement 300 that includes oscillator 100, which makes it possible to access oscillator 100 wherever it lies on the periphery.

FIG. 16 represents an example of one part of this coupling mechanism. Coupling ring 102 acts on two slopes 154 and 155 of lever 150 via a finger-piece 103 comprised therein, to control the tilting of lever 150, in its direction of rotation. The position represented in a solid line shows lever 150 in a position for locking toothing 15 of lower plate 14, via a comb 151 comprised in lever 150, in an "ON" position: balance 10 is in mesh with the motion-work and crown 110 of watch 1000. A lever jumper spring 156 introduces bistability to lever 150. To change to the unlocking position "OFF", in dotted lines in the Figure, ring 102 rotates downwards and causes the tipping and uncoupling of lever 150, releasing balance 10.

Although lever 150 includes a comb 151 here for cooperating with lower toothing 15 of lower plate 14, it is understood that it may also, when balance 10 is devoid of lower plate 14, include a friction surface arranged to cooperate and notably enter into contact with outer surface 120 of rim 12.

When lever 150 is released, the flexible structure is retained by an integrated jumper spring, such as jumper spring 42 of FIG. 4, or external jumper spring 29 of FIG. 12. This integrated jumper spring retains inertia block 4, and exerts a sufficient return force to also retain outer ring 2.

Preferably, in order to provide the system with maximum precision, the plates are micromachined (techniques derived from fabrication on silicon) and, if possible, each in a single layer (method using a mask), as represented. Lever 150, coupled by the action of ring 102, approaches balance 10 sideways (ON position) and angularly holds the latter by means of its comb 151 in mesh with lower plate 14 attached to balance 10. Drive wheel 81 then simultaneously meshes with upper plate 30.

The watch 1000 according to the invention comprises a control member consisting of a push piece, a pull-out piece, or similar, or, as represented in the Figures, notably in FIG. 20, a crown 110, which has the advantage of reversible adjustment in both directions. Rotation by crown 110, which is conventionally movable between at least two positions T1 and T3, causes the movement, via sliding pinion 111, of motion-work 112, of input wheel 115, of drive wheel 81, and thus of outer ring 2 of upper plate 30, which can pivot and change the inertia of balance 10.

Figure 15:
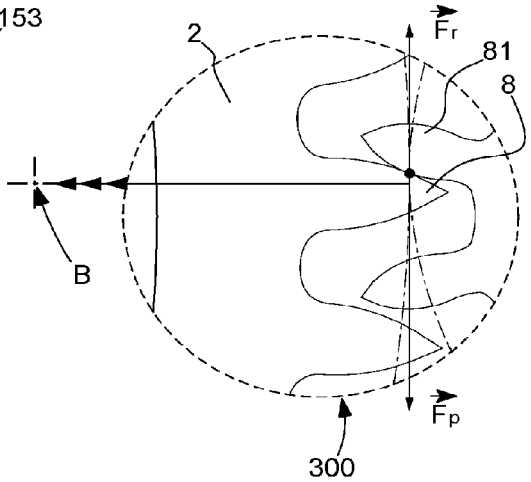
FIG. 15 is an enlarged detail of such meshing.

To ensure effortless insertion of the toothings, the latter are pointed, as seen in FIG. 15. Once inserted, as their profile is straight, or possibly even slightly negative, the contact shear forces exerted by drive wheel 81 and by comb 151 of lever 150 on upper and lower plates 30 and 14 does not cause any resulting radial force capable of moving the shock resistant pivots of balance 10.

Motion-work 112 may drive a centre wheel 113 carrying a hand 114 making it possible to view the adjustment made.

The invention also concerns a timepiece assembly comprising such a watch 1000, as seen in FIGS. 20 and 21, and an adjustment tool which is arranged to control the rotation of coupling ring 102.

Advantageously according to the invention, coupling ring 102 and adjustment tool 200, in particular consisting of a magnetic key, as illustrated, comprise complementary magnetic areas respectively 101, 201, for driving in rotation coupling ring 102 under the action of adjustment tool 200 when the complementary magnetic areas 101 and 201 are cooperating through watch case 1000. Ring 102 is advantageously, in a particular variant, provided with ferromagnetic targets 101: P, Q, R, S, carefully placed and concealed, so that only an external magnetic key 200 having magnetic studs 201, particularly neodymium magnets or similar, placed at certain locations P', Q', R', S', and opposite each other, can, if needed move and rotate the ring. The advantage of a purely ferromagnetic ring 102 of substantially circular shape, generally of revolution, is its insensitivity to external magnetic fields capable of causing it to pivot, and to external ferromagnetic objects, in the undesirable event that magnets are present.

FIG. 20 illustrates an overview of the device for adjusting rate by modifying the inertia of balance 10, without opening watch 1000 and without adding a push piece. Coupling ring 102 comprising ferromagnetic targets 101 is moved in rotation by a magnetic key 200, a tool external to the watch, comprising magnetic studs 201, when the latter is positioned coaxially to the watch (with their axes coinciding). Ring 102 may first of all be attracted axially against the magnets, then a rotation of key 200 causes a rotation of ring 10 by reluctance torque on ferromagnetic targets 101. Since the angular position of these targets is concealed from the user, only the right key will cause the ring to rotate. The objective is for the adjustment to be performed by the after-sales service to avoid tarnishing the reputation of the brand in the event of an unsuccessful attempt at adjustment by the user. Magnetic key 200 thus cooperates with coupling ring 102, in which the number and position of ferromagnetic targets 101 are concealed from the user, to prevent an unsuccessful attempt at adjustment by the user. Preferably, magnetic studs 201 are also concealed on key 200.

The rate adjustment process proceeds as follows. First, the pivoting of ring 102 by means of magnetic key 200 causes lever 150 to tilt in the direction of balance 10, in order to mesh drive wheel 81 of lever 150 with the rotary inertia adjustment device placed on balance 10. There is thus a change from the OFF position to the ON position. Drive wheel 81 is integral with intermediate wheel 115 of motion-work 112. Next, by pulling crown 110 into position T3 (time setting), crown 110 is in mesh both with minute hand 114 and with the inertia adjustment device of balance 10, via sliding pinion 111 and the intermediate wheel. Rotating crown 110 thus makes inertia adjustment possible, and it is also possible to read the correction via minute hand 114 which is very practical. Once the adjustment has been made, lever 150 is uncoupled with the aid of key 200, changing from the ON position to the OFF position, then the time is set and finally crown 110 is returned to position T1.

In short, the invention makes it possible:

to modify the inertia of the balance, notably over a range of typically 10 to 100 seconds per day, or more;

by modifying the position of inertia blocks between different stable positions, since they are always hooked inside notches;

with the aid of at least one micromachined, inertia adjustable, flexible element placed on the balance;

to obtain a mechanism for coupling rotation of the crown to the change of inertia via a magnetic key acting on a coupling ring through the case.

What is claimed is:

1. A timepiece balance wheel with adjustable inertia, comprising a staff carrying, a rim via at least one arm, and an inner flange secured to said staff and carrying an outer ring via a plurality of first elastic guide connections, which are inertia balanced in a plane perpendicular to an axis of said staff said outer ring being separate from said rim, a balance comprising a plurality of inertia-blocks, wherein said outer ring is arranged to pivot with respect to said inner flange under the action of an external torque exerted against a resistant torque exerted by said first elastic guide connections, and wherein each said inertia block is carried at least by said inner flange via at least a second elastic connection and can be indexed in a stable angular position defined by respective cooperation between a first indexing toothing carried by said inner flange or by one said inertia block, and a second indexing toothing which is respectively carried by said inertia block or by said outer ring, and wherein any rotation of said outer ring with respect to said inner flange modifies the angular position of said inertia blocks.

2. The timepiece balance wheel according to claim 1, wherein said first indexing toothing is carried by said inner flange and consists of an inner jumper spring, and wherein said second indexing toothing is carried by said inertia block and is a first toothed sector.

3. The timepiece balance wheel according to claim 1, wherein said first indexing toothing is carried by said inertia block and comprises at least one tooth, and wherein said second indexing toothing is carried by said outer ring and comprises at least a second toothed sector whose centre is distinct from said axis of said staff.

4. The timepiece balance wheel according to claim 1, wherein said first indexing toothing is carried by said inner flange, and includes a third toothed sector whose centre is distinct from said axis of said staff, and wherein said second indexing toothing is carried by said outer ring and consists of an external jumper spring.

5. The timepiece balance wheel according to claim 1, wherein each said inertia block is carried by said outer ring by at least a third elastic connection.

6. The timepiece balance wheel according to claim 1, wherein said inner flange comprises a plurality of elastic strips concentrically clamping said staff with a friction torque greater than a maximum value of said external torque.

7. The timepiece balance wheel according to claim 1, wherein said inner flange is irreversibly attached to said staff.

8. The timepiece balance wheel according to claim 1, wherein said balance includes a lower plate directly or indirectly fixed to said staff and including peripheral stop means.

9. The timepiece balance wheel according to claim 1, wherein said outer ring comprises a peripheral and continuous toothing centred on said axis of said staff, and wherein rotation of said toothing modifies the position of said inertia blocks between two stable indexing positions.

10. The timepiece balance wheel according to claim 1, wherein said balance includes a one-piece upper plate which includes said inner flange, said first elastic guide connections, said outer ring, said inertia blocks, said second elastic connections, said first indexing toothings and said second indexing toothings.

11. The timepiece balance wheel according to claim 10, wherein each said inertia block is carried by said outer ring by at least a third elastic connection, and wherein said one-piece upper plate further includes said third elastic connections.

12. The timepiece balance wheel according to claim 10, wherein said one-piece upper plate is a flexible planetary structure, whose planets are said inertia blocks permitting inertia adjustment, which are connected to said inner flange and/or to said outer ring by means of elastic strips.

13. A mechanical timepiece movement comprising at least one timepiece oscillator mechanism including said balance according to claim 1, wherein mechanical movement includes an operating member arranged to control inertia adjustment of said balance by modifying a position of at least some of said inertia blocks comprised in said balance, said operating member being movable between a coupled position and at least one uncoupled position, wherein said operating member comprises a stop means arranged to directly or indirectly immobilise said rim in said coupled position, and at least one control means arranged, in said coupled position, to drive in rotation said outer ring to modify the position of said inertia blocks which cooperate with said outer ring.

14. The mechanical movement according to claim 13, wherein rotation of said outer ring is accomplished by said control means which includes a drive wheel adjacent to said balance, carried by a bistable lever comprised in said stop means, said lever being coupled/uncoupled sideways by mechanical action of a rotary ring peripheral to said timepiece movement.

15. A watch comprising said movement according to claim 14, and a control member consisting of a push piece or a crown arranged to control, via a sliding pinion, the movement of a motion-work, wherein said motion-work includes an input wheel arranged to drive at least said control means in said coupled position of said operating member, and further wherein said watch includes a coupling ring that can be moved in rotation to control coupling or uncoupling of said operating member.

16. A timepiece assembly comprising said watch according to claim 15, and an adjustment tool arranged to allow the inertia adjustment of said balance, wherein said adjustment tool is arranged to control the rotation of said coupling ring, and wherein said coupling ring and said adjustment tool include complementary magnetic areas for driving in rotation said coupling ring under the action of said adjustment tool when said complementary magnetic areas are cooperating through a case of said watch.

17. The timepiece assembly according to claim 16, wherein said adjustment tool is a magnetic key comprising magnetic studs and arranged to cooperate with said coupling ring, whose magnetic areas are ferromagnetic targets, a number and position of which are concealed from a user, to prevent an unsuccessful attempt at adjustment by the user.

* * * * *